US008261941B2

(12) United States Patent
Woo et al.

(10) Patent No.: US 8,261,941 B2
(45) Date of Patent: Sep. 11, 2012

(54) FLUID DISPENSER

(75) Inventors: Ji Sung Woo, Sha Tin (HK); Chan Chung Yin, Tseung Kwan O (HK); Liu Wan Bao, Shen Zhen (CN); Kenneth L. Kramer, Tai Po Kau (HK); Lam Yau Ming, Tai Po (HK); Peng Zhi Gang, Jiangsu Province (CN)

(73) Assignee: American Sterilizer Company, Mentor, OH (US)

( * ) Notice: Subject to any disclaimer, the term of this patent is extended or adjusted under 35 U.S.C. 154(b) by 629 days.

(21) Appl. No.: 12/483,532

(22) Filed: Jun. 12, 2009

(65) Prior Publication Data

US 2009/0308887 A1 Dec. 17, 2009

Related U.S. Application Data

(60) Provisional application No. 61/061,311, filed on Jun. 13, 2008.

(51) Int. Cl.
*B67D 5/22* (2006.01)

(52) U.S. Cl. ..... 222/52; 222/63; 222/113; 222/181.3; 222/333; 222/214

(58) Field of Classification Search ..... 222/214, 222/181.3, 113, 52, 63, 333, 23
See application file for complete search history.

(56) References Cited

U.S. PATENT DOCUMENTS

| | | | | |
|---|---|---|---|---|
| 4,178,975 | A | 12/1979 | Crespi | 141/362 |
| 4,667,854 | A | 5/1987 | McDermott et al. | 222/101 |
| 4,722,372 | A | 2/1988 | Hoffman et al. | 141/98 |
| 4,921,150 | A | 5/1990 | Lagergren et al. | 222/639 |
| 4,946,070 | A | 8/1990 | Albert et al. | 222/52 |
| 5,031,258 | A | 7/1991 | Shaw | 4/623 |
| 5,105,992 | A | 4/1992 | Fender et al. | 222/185 |
| 5,248,066 | A | 9/1993 | Olson et al. | 222/105 |
| 5,333,758 | A * | 8/1994 | Jamison et al. | 222/101 |
| 5,353,963 | A * | 10/1994 | Gorski et al. | 222/129.1 |
| 5,377,871 | A | 1/1995 | Banks et al. | 222/41 |
| 5,540,362 | A * | 7/1996 | Azuma et al. | 222/642 |
| 6,036,056 | A | 3/2000 | Lee et al. | 222/63 |
| 6,131,773 | A | 10/2000 | Wade et al. | 222/153.02 |
| 6,189,740 | B1 | 2/2001 | Wade et al. | 222/207 |
| 6,209,752 | B1 | 4/2001 | Mitchell et al. | 222/63 |
| 6,347,724 | B1 * | 2/2002 | Chen et al. | 222/1 |
| 6,598,765 | B2 * | 7/2003 | Pagel et al. | 222/214 |

(Continued)

*Primary Examiner* — Kevin P Shaver
*Assistant Examiner* — Donnell Long
(74) *Attorney, Agent, or Firm* — Kusner & Jaffe; Michael A. Centanni

(57) ABSTRACT

The present invention provides a fluid dispenser for dispensing a fluid from a container. A roller is dimensioned to engage and roll along a portion of the container when the roller moves in a first direction from a first container-engaging position to a second container-engaging position. A sensor for sensing an object in a predetermined area is disposed near the housing. A light source is operable to emit a beam of visible light therefrom. The beam of light intersects the predetermined area. A controller is programmed such that when the sensor senses an object in the predetermined area, the controller energizes the light source to illuminate a target location where the fluid from the container is to be dispensed and the controller causes the roller to move in the first direction from the first container-engaging position to the second container-engaging position, thereby dispensing the fluid from the container.

10 Claims, 14 Drawing Sheets

U.S. PATENT DOCUMENTS

| | | | | |
|---|---|---|---|---|
| 6,938,795 | B2 * | 9/2005 | Barton et al. | 222/1 |
| 6,948,638 | B2 | 9/2005 | Tu | 222/209 |
| 7,281,643 | B2 | 10/2007 | Lin | 222/214 |
| 7,364,053 | B2 | 4/2008 | Ophardt | 222/190 |
| 7,651,010 | B2 * | 1/2010 | Orzech et al. | 222/214 |
| 7,845,593 | B2 * | 12/2010 | Formon et al. | 242/560.1 |
| 2004/0226962 | A1 | 11/2004 | Mazursky et al. | 222/95 |
| 2006/0292021 | A1 | 12/2006 | Tu | 417/477.1 |
| 2007/0068966 | A1 * | 3/2007 | Orzech et al. | 222/136 |
| 2007/0194045 | A1 * | 8/2007 | Py et al. | 222/105 |
| 2008/0121662 | A1 * | 5/2008 | Gehl | 222/214 |
| 2011/0017778 | A1 * | 1/2011 | Kadiks et al. | 222/190 |

* cited by examiner

FLUID DISPENSER

RELATED APPLICATIONS

This application claims the benefit of U.S. Provisional Application No. 61/061,311, filed Jun. 13, 2008, which is fully incorporated herein by reference.

FIELD OF THE INVENTION

The present invention relates generally to the dispensing arts, and more particularly to a soap dispenser for dispensing discrete doses of soap, liquid antimicrobial compositions, hand lotions, creams, and the like. The invention is also applicable to a dispenser for the dispensing of other viscous materials, such as food products.

BACKGROUND OF THE INVENTION

Hand-operated dispensers are widely used for delivery of liquid soaps, hand lotions, creams, and the like. Such dispensers are typically mounted on a wall and include a housing and a dispensing mechanism. The fluid to be dispensed is stored in a replaceable reservoir, such as a plastic container, within the housing and is delivered, as needed, by actuating the dispensing mechanism. Conventional dispensing mechanisms include rollers or plates that engage a portion of the replaceable reservoir. When the roller or plate engages the portion of the replaceable reservoir, the fluid in the reservoir is forced out through an opening in the reservoir.

A user operating such hand-operated dispensers typically pushes or pulls on a handle that extends beneath the dispenser to receive the dose of soap. However, during the movement of the user's hand, the palm of the hand may move such that some of the soap may not be received in the palm. Wastage of soap often results. More importantly, for antiseptic soaps, decontamination is only assured when a complete dose is applied to the hands. Soap that trickles through the fingers or misses the hand completely does not contribute to thorough decontamination.

There remains a need, therefore, for a dispenser which dispenses discrete doses of fluid accurately and reproducibly. The present invention provides a new and improved fluid dispenser which overcomes the above-referenced problems and others.

SUMMARY OF THE INVENTION

In accordance with an embodiment of the present invention, there is provided a fluid dispenser for dispensing a fluid comprised of a housing dimensioned to receive a container for holding a fluid to be dispensed. The housing has a cover that is dimensioned to move between a closed position and an open position. A roller assembly is disposed in the housing. The roller assembly is dimensioned to engage a portion of the container. The roller assembly includes a holder and a roller that is rotatably attached to the holder. The holder is rotatable about an axis of the roller assembly such that the roller is movable along a path between a first container-engaging position and a second container-engaging position. The roller is dimensioned to engage and roll along a portion of the container when the roller moves in a first direction from the first container-engaging position to the second container-engaging position, thereby dispensing the fluid from the container. A motor is operable to rotate the holder in the first direction and in a second direction along the path. The second direction is opposite the first direction. A sensor for sensing an object in a predetermined area located generally beneath the dispenser is disposed within the housing. A light source is operable to emit a beam of visible light. The beam of visible light intersects the predetermined area. A controller is programmed such that when the sensor senses an object in the predetermined area, the controller energizes the light source to illuminate a target location where the fluid from the container is to be dispensed. The controller also initiates a dispensing cycle wherein the motor moves the holder in the first direction such that the roller engages and moves along the path from the first container-engaging position to the second container-engaging position thereby dispensing the fluid from the container.

One advantage of the present invention is a dispenser that dispenses measured doses of an antiseptic soap.

Another advantage of the present invention is a dispenser that dispenses a fluid without the hands of the user touching the dispenser.

Another advantage of the present invention is a dispenser that dispenses a fluid when the hands of a user are in proximity to the dispenser.

Yet another advantage of the present invention is a dispenser as described above that indicates to a user where the fluid will be dispensed.

Yet another advantage of the present invention is a dispenser that projects a beam of visible light that is incident on a hand placed under the dispenser, the beam of light providing a visible target on the hand where soap will impinge when dispensed.

Still another advantage of the present invention is a dispenser that dispenses both small and large doses of soap with a high degree of reproducibility.

Another advantage of the present invention is a dispenser as described above, wherein the amount of fluid dispensed by the dispenser during a dispensing cycle is variable and settable by a maintenance person.

Another advantage of the present invention is a dispenser as described above, that indicates to a maintenance person when the level of fluid in the dispenser is low.

Still further advantages of the present invention will become apparent to those of ordinary skill in the art upon reading and understanding the following detailed description of the preferred embodiment.

BRIEF DESCRIPTION OF THE DRAWINGS

The invention may take physical form in certain parts and arrangements of parts, one embodiment of which will be described in detail in the specification and illustrated in the accompanying drawings which form a part hereof, and wherein.

DETAILED DESCRIPTION

Figure 1:
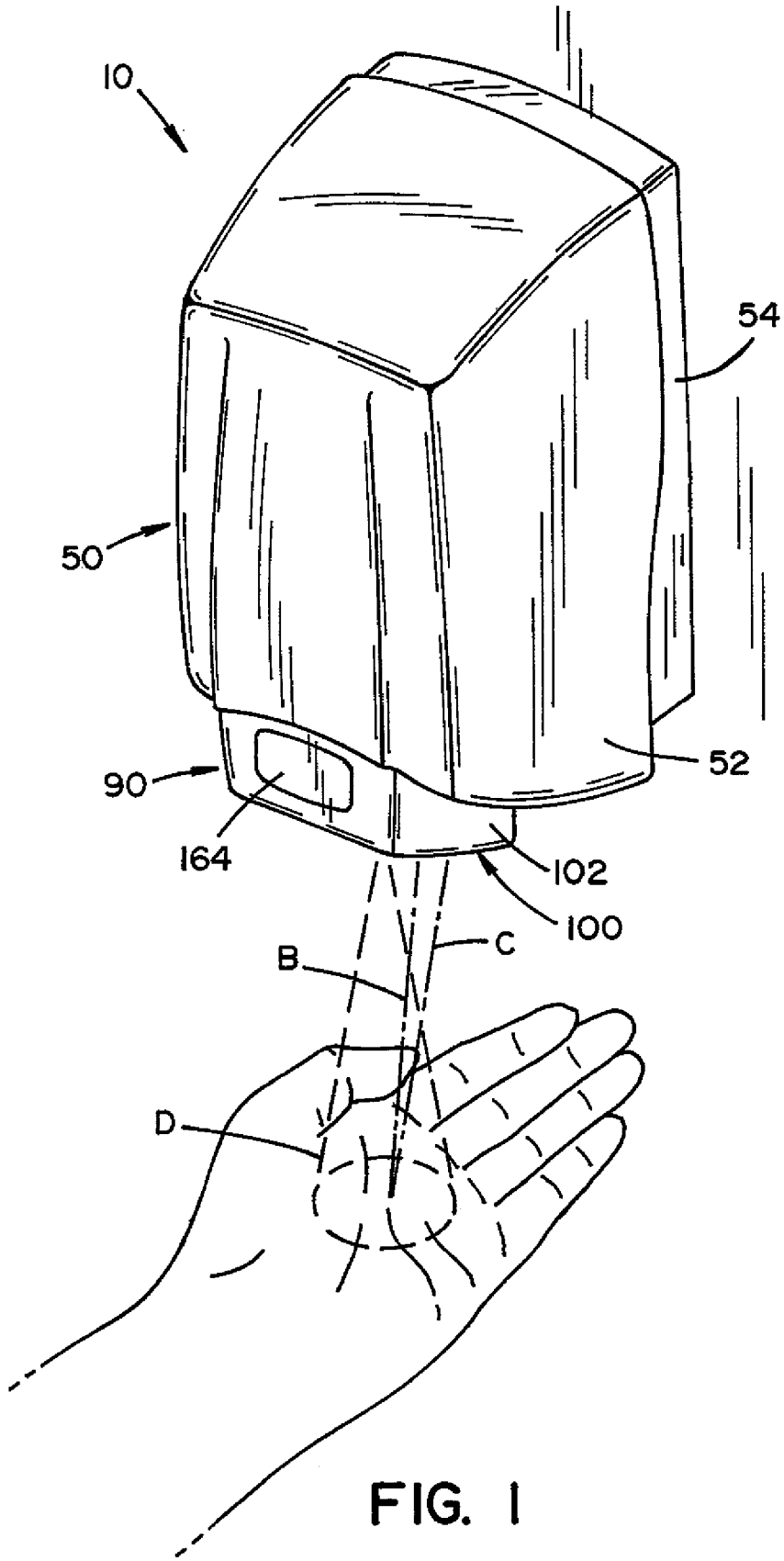
FIG. 1 is a perspective view of a fluid dispenser illustrating a preferred embodiment of the present invention.
Figure 2:
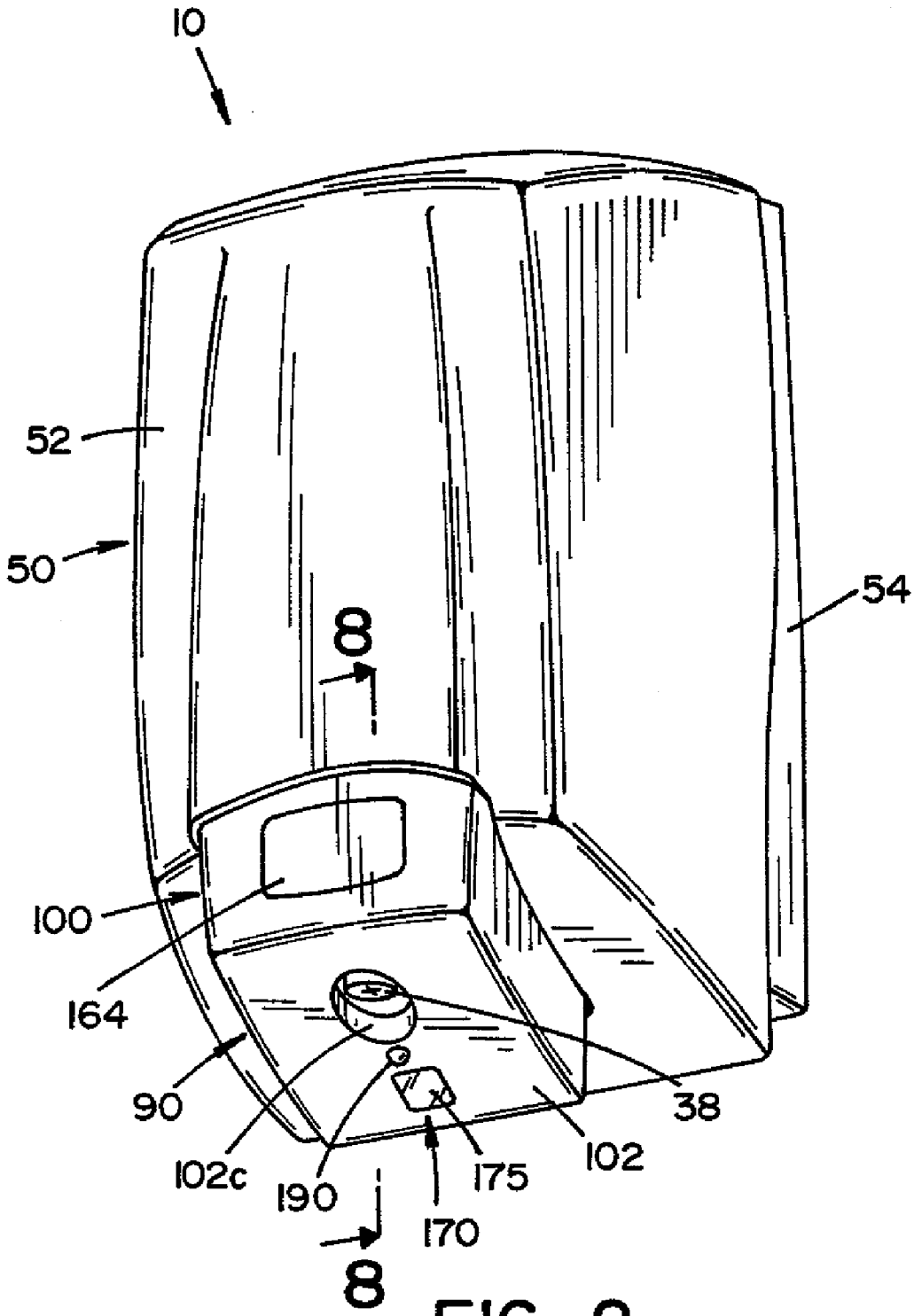
FIG. 2 is a perspective view from below of the fluid dispenser shown in FIG. 1.
Figure 3:
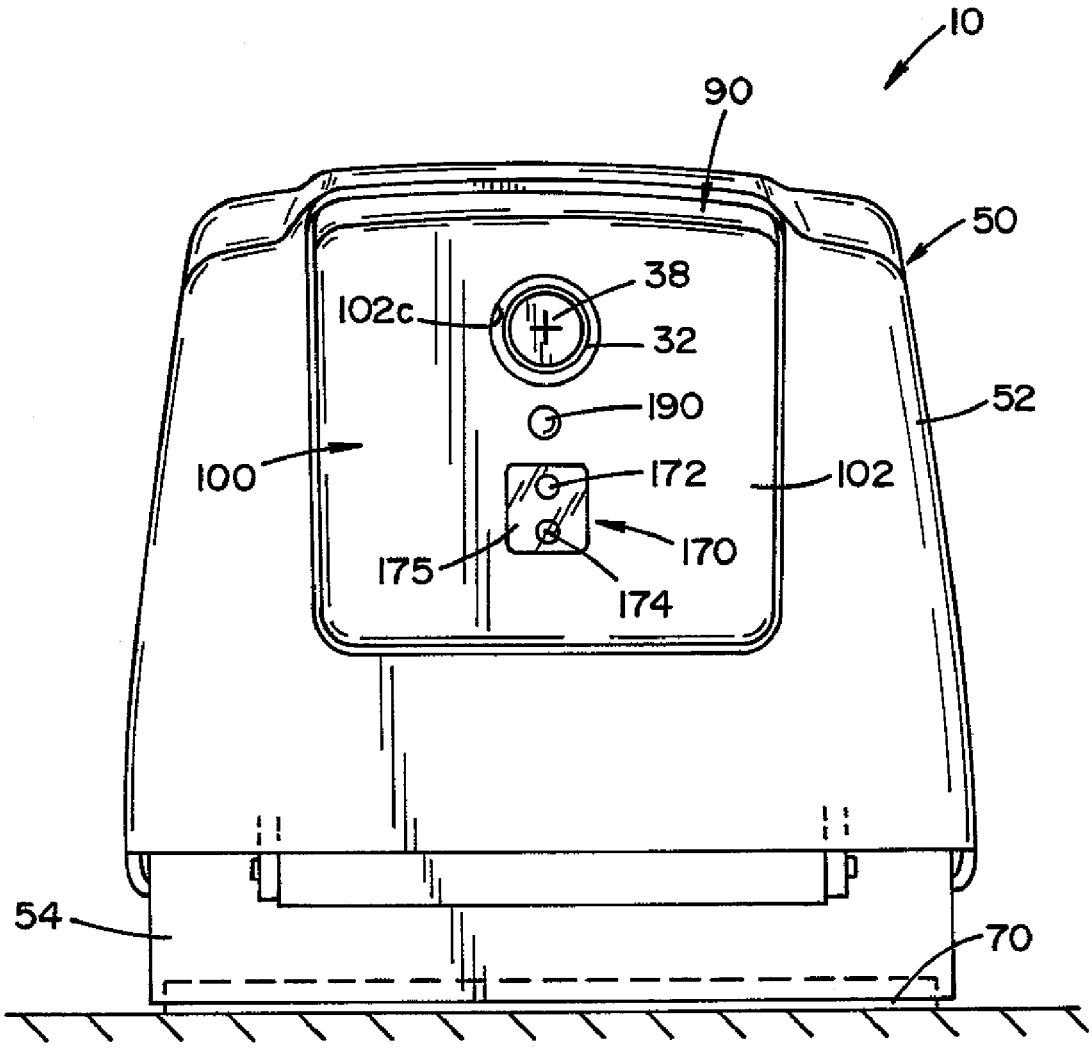
FIG. 3. is a bottom view of the fluid dispenser shown in FIG. 1.

Referring now to the drawings wherein the showings are for the purpose of illustrating one embodiment of the invention only, and not for the purpose of limiting the same, FIG. 1 shows a fluid dispenser 10, illustrating a preferred embodiment of the present invention. Dispenser 10 shall be described with particular reference to the dispensing of antiseptic soaps. It should be appreciated, however, that the dispensing of other fluids and viscous materials is also contemplated. The Assignee has other prior fluid dispenser patents, e.g., U.S. Pat. Nos. 6,131,773 and 6,189,740, incorporated herein by reference.

Figure 6:
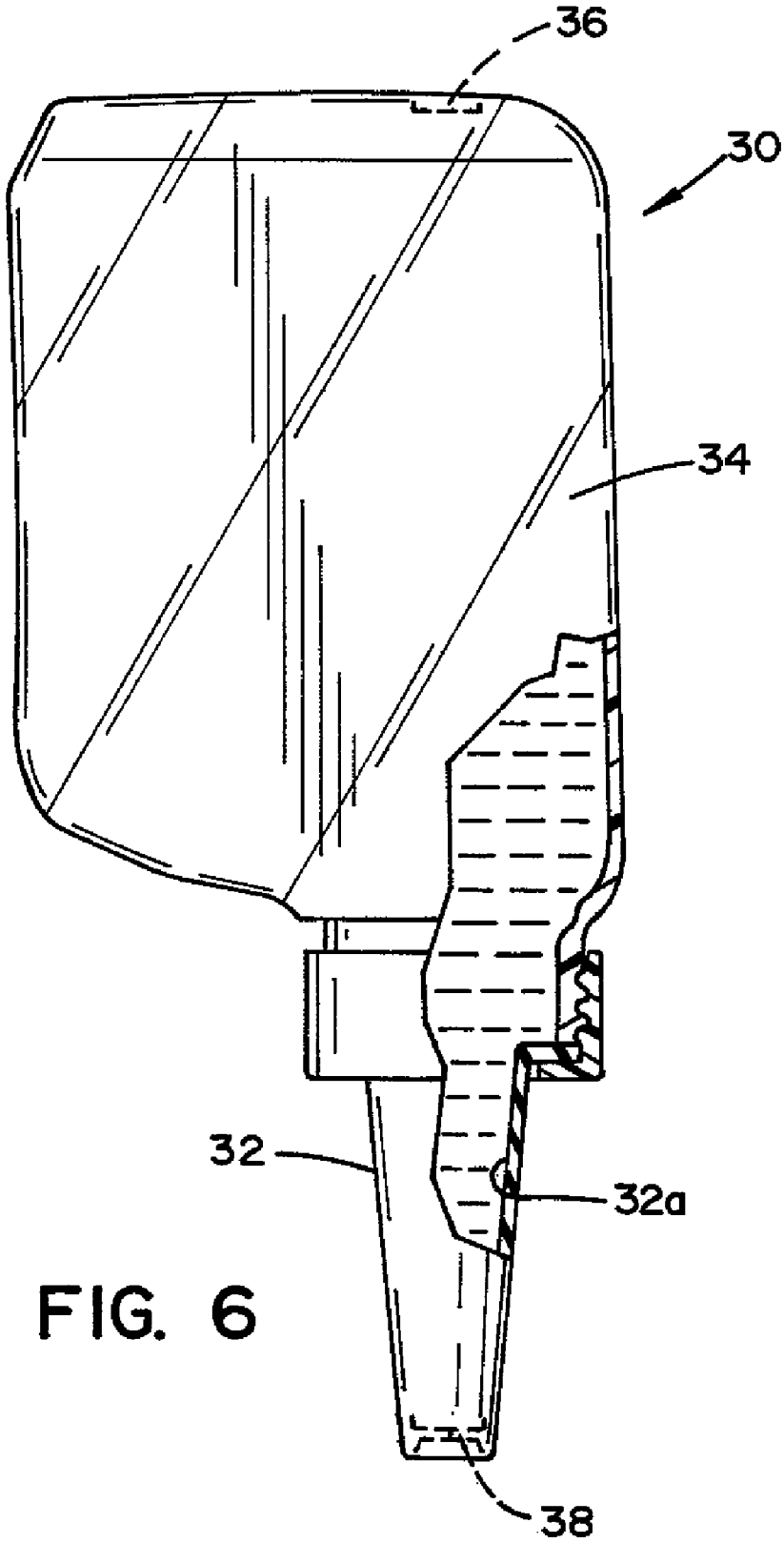
FIG. 6 is partially sectioned, side elevation view of a replaceable fluid reservoir.

Dispenser 10 is dimensioned to accept a replaceable fluid reservoir 30. Reservoir 30, as seen in FIG. 6, includes a dispensing tube 32 that defines a fluid pathway 32*a*, a container 34 which holds an antiseptic soap or other cleaning fluid to be dispensed and a vent system 36.

Dispensing tube 32 is approximately 5-8 cm in length and has side walls which taper inwardly from a top portion, or upstream end, adjacent container 34, towards a dispensing, or downstream end of dispensing tube 32. The taper is preferably 0-15 degrees from the vertical, with a particularly preferred taper of 4-6 degrees. Dispensing tube 32 is made from a material that has a memory, i.e., it can be compressed and then returns to its original shape, when released. A preferred material for dispensing tube 32 is silicone rubber, although other resiliently flexible materials are also contemplated.

A self sealing valve 38 is disposed in the free end of dispensing tube 32. Valve 38 limits air ingress into container 34 through dispensing tube 32 and thereby prevents bioburden from entering into the soap product.

Vent system 36 is disposed in an indented region in a top portion of container 34. The indentation protects vent system 36 from accidental activation during shipment and storage of reservoir 30. Vent system 36 includes a filter system, that covers an opening in the top portion of the container wall.

In one embodiment, the filter system includes three layers that selectively seal the opening during storage and allow filtered air to pass into container 34 to replace soap as it is dispensed. The layers are a top, or filter layer formed from an expandable filter material, such as polytetrafluoroethylene (PTFE), an intermediate, or barrier layer of aluminum foil or other occlusive material that is non-reactive with the soap in reservoir 30, and a lower, or bonding layer which bonds readily to the top portion of the container wall around the opening. Where container 34 is formed from polyethylene, the bonding layer is preferably formed from a polyethylene film. The filter layer filters out particles from incoming air down to about 0.3 microns. The barrier layer prevents ingress of air into reservoir 30 during transportation and storage and also prevents blocking of the filter with deposits from the cleaning fluid. The layers are bonded to the container wall around a depression in the wall that surrounds the opening.

Figure 5:
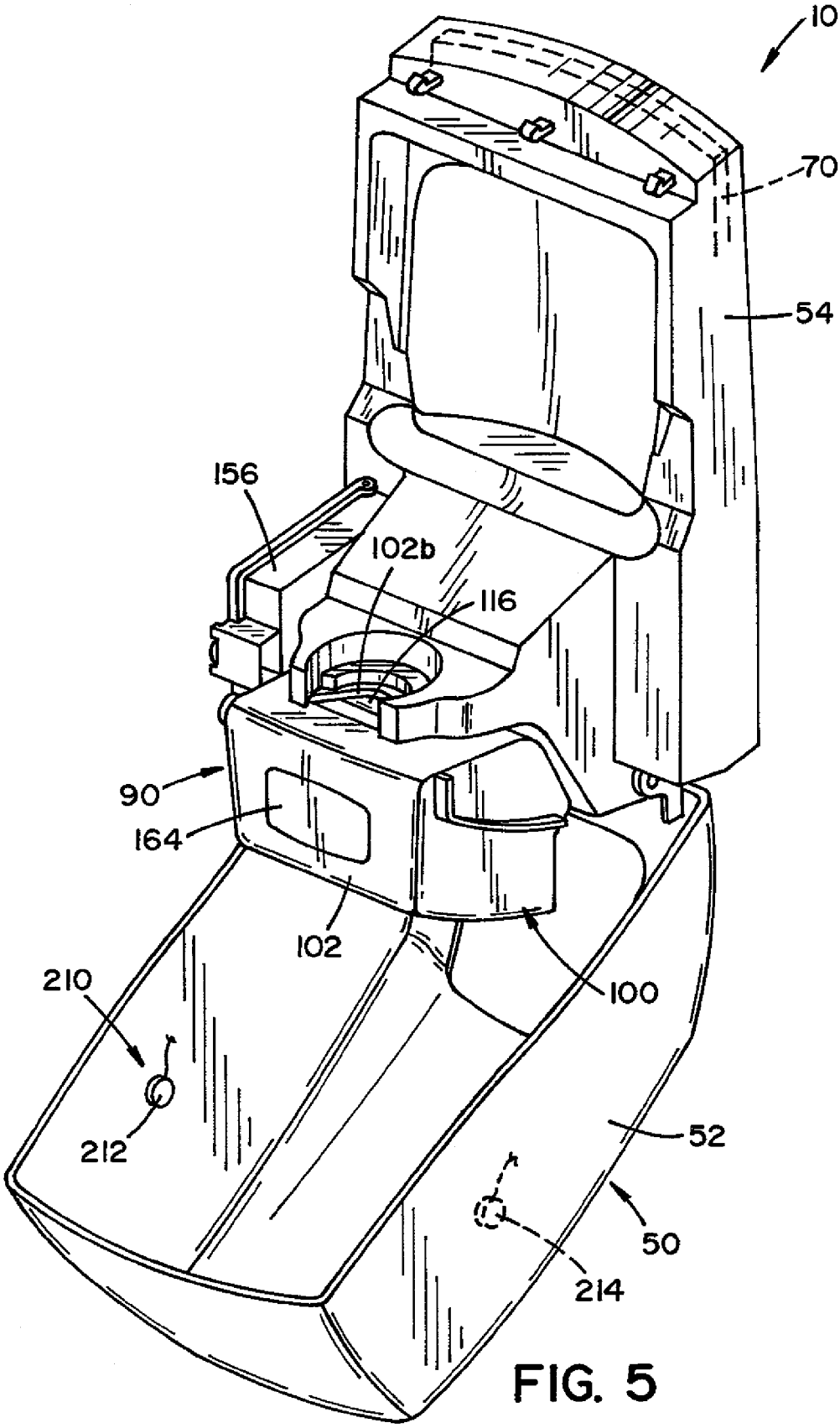
FIG. 5 is a perspective view of the fluid dispenser shown in FIG. 1, illustrating a front cover in an open position.

Referring now to FIG. 5, fluid dispenser 10 is shown in an open position. Fluid dispenser 10 includes a housing 50 that has a front cover 52 and a back plate 54. Front cover 52 is pivotally connected to back plate 54 and pivots open to allow reservoir 30 to be received into back plate 54. A wall mounting system 70 mounts fluid dispenser 10 to a wall or other suitable mounting surface. A dispensing system 90 is disposed in a lower portion of back plate 54.

Figure 4:
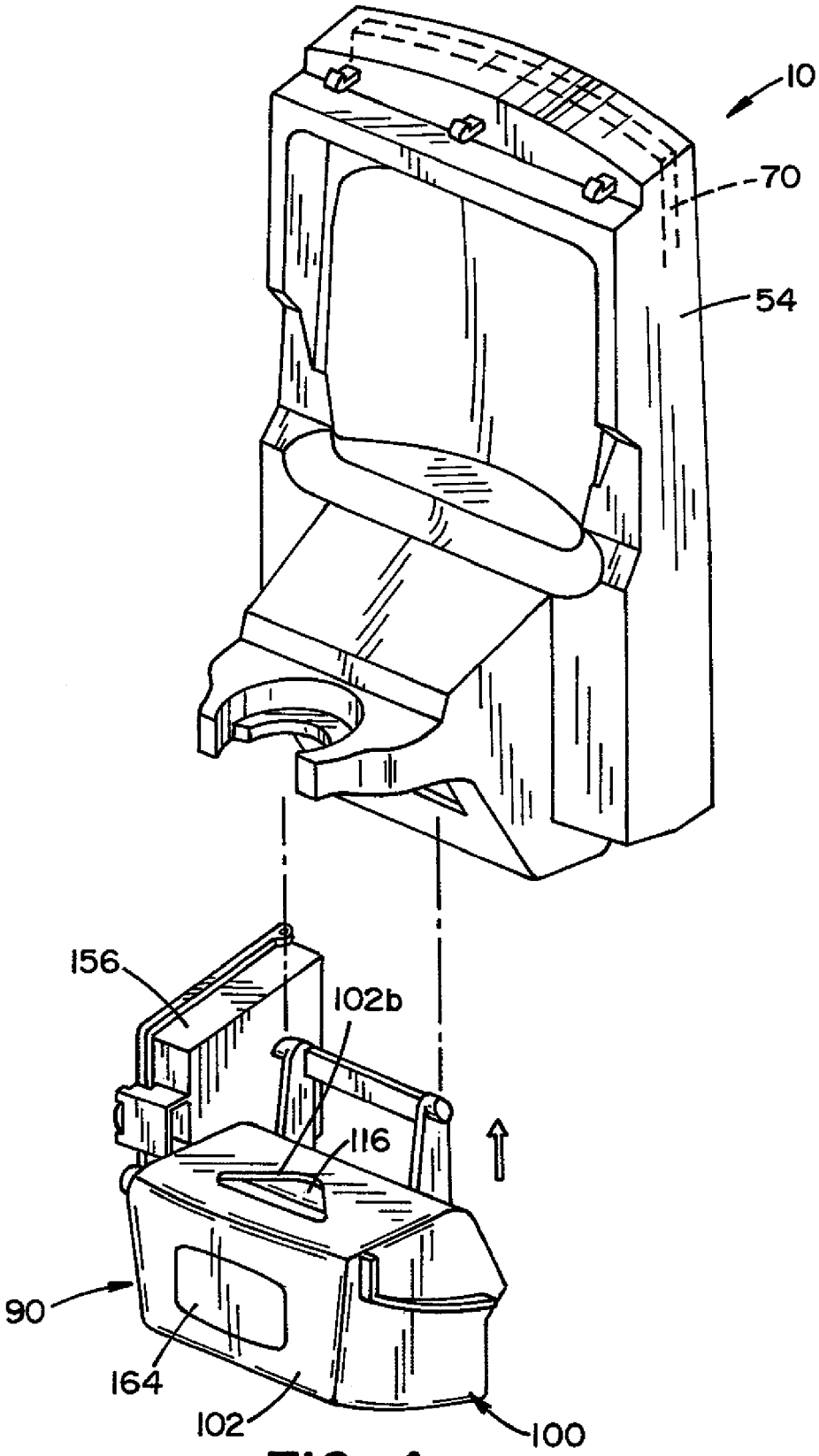
FIG. 4 is an exploded, perspective view of a dispensing system and a back plate from the fluid dispenser shown in FIG. 1.

Dispensing system 90 is provided to dispense measured doses of a fluid from fluid dispenser 10. Dispensing system 90 is designed to be an integrated part of dispenser 10, or a unit that may be retrofitted into an existing dispenser 10, as illustrated in FIG. 4. As shown in FIGS. 2-5, dispensing system 90 generally includes a dispensing roller assembly 100, a controller (not shown), a triggering assembly 170, a target light 190 and a low level indicator assembly 210.

Figure 7:
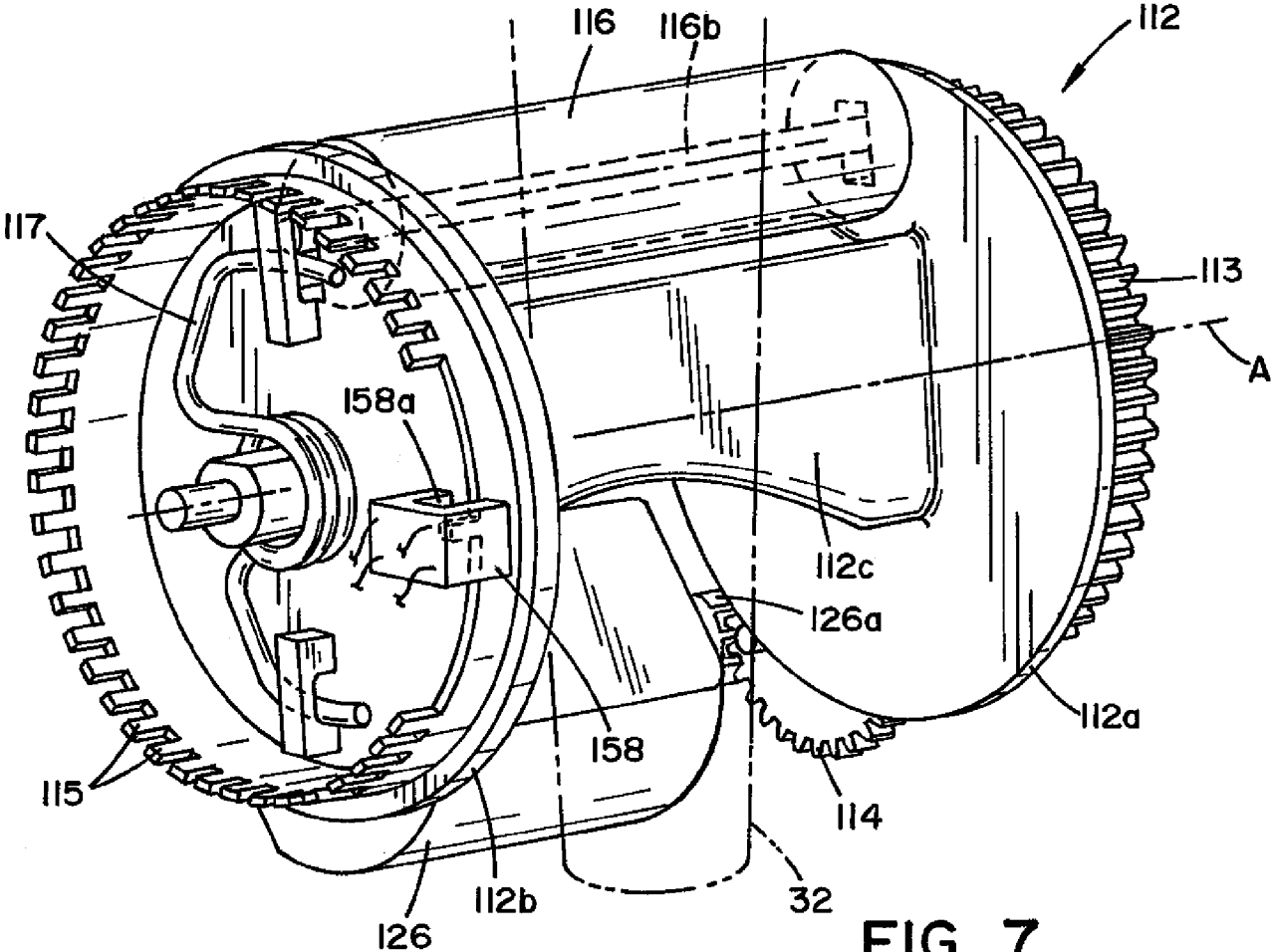
FIG. 7 is a perspective view of a holder of a roller assembly of the fluid dispenser shown in FIG. 1.
Figure 8:
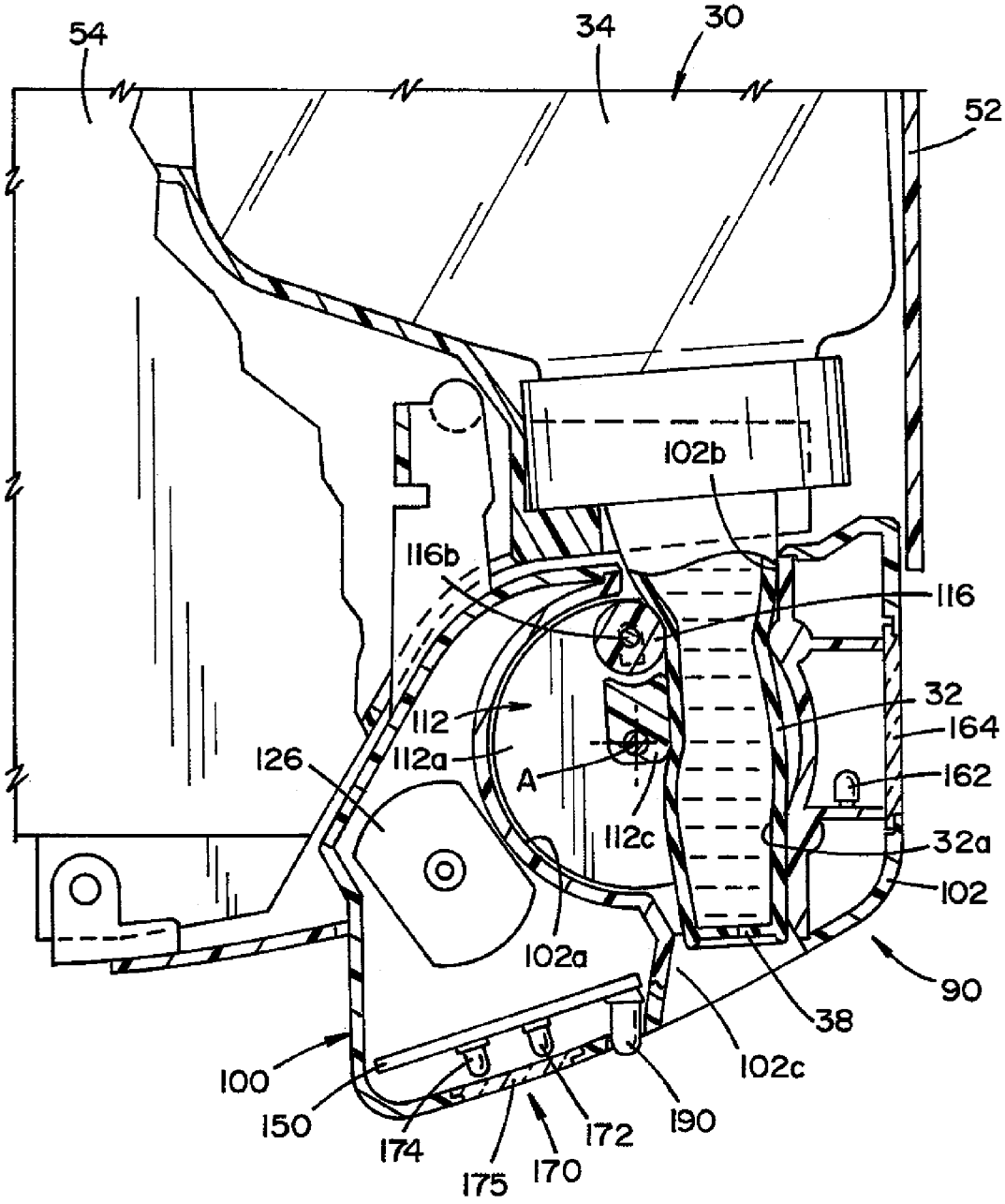
FIG. 8 is a sectional view taken along line 8-8 of FIG. 2, illustrating a dispensing system at an at-rest position.

Referring now to FIGS. 7 and 8, roller assembly 100 is best shown. Roller assembly 100 generally includes a housing 102, a holder 112, a roller 116, a gear assembly 114 and a motor 126.

Housing 102 is dimensioned to mount to back plate 54. Housing 102 defines a cavity 102*a*. An inlet 102*b* and an outlet 102*c* are formed in housing 102 to communicate with cavity 102*a* in housing 102. Inlet 102*b* is disposed on the top of housing 102 and outlet 102*c* is disposed on the bottom of housing 102. Inlet 102*b* and outlet 102*c* of housing 102 are aligned and are dimensioned to allow dispensing tube 32 of reservoir 30 to extend therethrough along one side of cavity 102*a*. Cavity 102*a* is dimensioned to accept holder 112.

Holder 112 is operable to rotate within cavity 102*a* of housing 102. As shown in FIG. 7, holder 112 includes a first disk 112*a*, a second disk 112*b* and a central hub 112*c*. First disk 112*a* and second disk 112*b* are disposed on either end of central hub 112*c*. A plurality of gear teeth 113 is formed in an outer surface of first disk 112*a*. A plurality of discrete tabs 115 extends axially outward from an outer surface of second disk 112*b*. Tabs 115 are arranged in a circle on the outer surface of second disk 112*b*. Holder 112 is rotatable about a central axis "A" that extends through central hub 112*c*.

Roller 116 is disposed between first disk 112*a* and second disk 112*b* of holder 112. A shaft 116*b* extends through roller 116. One end of shaft 116*b* of roller 116 is rotatably attached to first disk 112*a* and another end of shaft 116*b* of roller 116 is rotatably attached to second disk 112*b*. A central axis of first roller 116 is parallel to central axis "A" of holder 112. Springs 117 are disposed on first disk 112*a* and second disk 112*b* of holder 112. Only spring 117 on second disk 112*b* is shown in FIG. 7. Springs 117 bias shaft 116*b* radially outward relative to first disk 112*a* and second disk 112*b*.

Gear assembly 114 is designed to matingly engage gear teeth 113 of first disk 112*a* of holder 112. A reversible motor 126 includes a gear 126*a* that matingly engages gear assembly 114. In this respect, motor 126 is operable to turn gear assembly 114 and holder 112. Motor 126 is operable to turn in a first direction and a second direction. The second direction being opposite the first direction. Gear assembly 114, in turn, is operable to cause holder 112 to rotate about axis "A" within cavity 102*a* of housing 102, when motor 126 is actuated. Motor 126 includes wires that are connectable to circuit board 150.

The controller is programmed to control the operation of dispensing system 90. The controller is attached to circuit board 150, shown in FIG. 8. Circuit board 150 is connected to a limit switch 152, a dispense adjuster, or volume regulator 154, a battery pack 156, a sensor 158 and an indicator light 162. The controller uses a pulse width modulation (PWM) control and a DC brake for accurate rotational positioning of motor 126 and holder 112.

Figure 11:
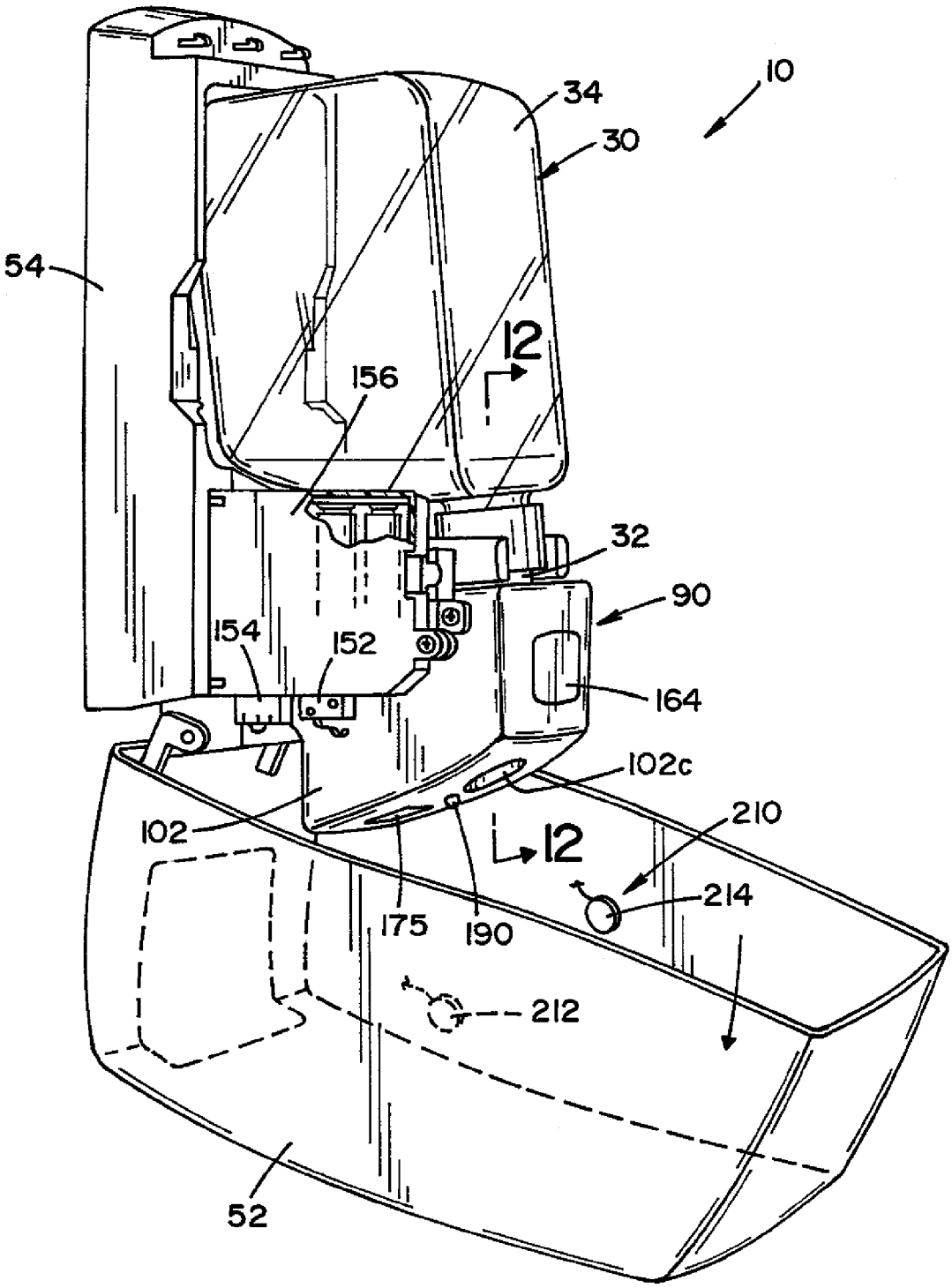
FIG. 11 is a perspective view of the fluid dispenser shown in FIG. 1, illustrating a front cover in an open position.

As seen in FIG. 11, limit switch 152 is attached to a side of housing 102 of dispensing system 90. Limit switch 152 is disposed to engage front cover 52 when front cover 52 is in a closed position relative to back plate 54. Limit switch provides a signal to the controller indicative of when front cover 52 of dispenser 10 is in a closed position relative to back plate 54.

Dispense adjuster, or volume regulator 154 provides a signal to the controller indicative of a desired volume to be dispensed. Volume regulator 154 has a number of fixed positions. Each position provides a signal to the controller indicative of a desired volume of the fluid to be dispensed with each actuation stroke. In the embodiment shown, volume regulator 154 has three (3) such fixed positions that nominally dispense 1 ml, 1½ ml, and 2 ml of fluid, respectively. It is also contemplated that volume regulator 154 may have more or less than three (3) fixed positions.

As seen in FIG. 7, sensor 158 is attached to a bracket (not shown) such that sensor 158 is disposed near second disk 112*b*. Sensor 158 includes a slot 158*a* that is dimensioned to allow tabs 115 to pass therethrough. Sensor 158 provides a signal to the controller indicative of the presence of one of the plurality of tabs 115 in slot 158*a* of sensor 158. In other words, sensor 158 is operable to provide a signal to the controller each time that one of the plurality of tabs 115 passes sensor 158.

As seen in FIG. 8, indicator light 162 is disposed in housing 102. Indicator light 162 is disposed behind a lens 164 of housing 102. Indicator light 162 is connected to the controller such that the controller is operable to energize indicator light 162 when a fluid dispensing cycle is being performed, as shall be described in greater detail below.

Triggering assembly 170 is attached to the bottom of circuit board 150. A lens 175 of housing 102 is disposed between triggering assembly 170 and the surrounding environment. Triggering assembly 170 provides a signal to the controller indicative of the presence of an object in a triggering field. The triggering field, as illustrated in FIG. 1 by lines "B" and "C," is established by the cooperation of a radiation emitting diode 172 and a radiation sensor 174. Diode 172 emits radiation in the infrared range at an angle from the bottom of housing 102 through lens 175 of housing 102. The radiation from diode 172 is represented by line "B" in FIG. 1. Spaced from diode 172 is a radiation sensor 174. In the embodiment shown, diode 172 and radiation sensor 174 are disposed to one side of dispensing tube 32 of reservoir 30. As illustrated by line "C" in FIG. 1, radiation from diode 172 is reflected by an object in the triggering field. Radiation sensor 174 detects the reflected radiation and provides a signal to the controller. When an object is not present, radiation from diode 172 is not reflected to radiation sensor 174 but rather dissipates out into space. The position and size of the triggering field, that is the zone in which the presence of a reflective object will trigger radiation sensor 174, is determined by the separation of diode 172 and the angle of incidence of diode 172. In this respect, a more downwardly directed beam will lower the triggering field while moving the beam direction towards horizontal will raise the triggering field position. Furthermore, a more intense energy stream from diode 172 will be reflectable in sufficient amount to trigger radiation sensor 174 from a greater distance.

Target light 190 is disposed on a bottom of circuit board 150 to one side of diode 172 and radiation sensor 174, as shown in FIG. 8. Target light 190 is operable to provide a beam of visible light therefrom, as illustrated by lines "D" in FIG. 1. The beam of light from target light 190 is directed at the triggering field. In the embodiment shown, the beam of light is blue.

A low level indicator assembly 210, as shown in FIG. 5, is disposed in housing 50 of dispenser 10 to provide an indication of when the level of fluid in reservoir 30 is at a predetermined level. Low level indicator assembly 210 includes an emitter 212 and a receiver 214. Emitter 212 is operable to emit radiation therefrom. Receiver 214 is operable to sense the radiation from emitter 212. Emitter 212 and receiver 214 are disposed on opposite sides of the interior of housing 50 of dispenser 10. Emitter 212 is orientated towards receiver 214 such that radiation from emitter 212 is directed towards receiver 214. In one embodiment (not shown), dispensing tube 32 of reservoir 30 is disposed between emitter 212 and receiver 214.

The present invention shall now be described with reference to the operation of dispenser 10. As stated above, dispensing system 90 is designed to dispense measured doses of a fluid. The fluid is ejected through valve 38 at the end of dispensing tube 32 of reservoir 30. A typical dispensing cycle includes an actuation stroke, in which fluid is dispensed, and a return stroke, in which the moveable parts of dispensing system 90 return to an at-rest orientation.

When dispensing system 90 is in the at-rest orientation, as best seen in FIG. 8, roller 116 of holder 112 is disposed in an uppermost or first, container-engaging position. Dispensing tube 32 of reservoir 30 is full of a fluid and extends through one side of cylindrical cavity 102*a* in housing 102. As best seen in FIG. 7, dispensing tube 32 (shown in phantom) is disposed between first disk 112*a* and second disk 112*b* of holder 112 to one side of central hub 112*c*.

The initiation of the dispensing cycle of dispensing system 90 is controlled by triggering assembly 170. As described above, diode 172 emits radiation therefrom. The radiation from diode 172, illustrated by line "B" in FIG. 1, is emitted into space. When an object, such as a user's hand, intersects the radiation at a predetermined location, also called the triggering field, the radiation is reflected back towards radiation sensor 174, as illustrated by line "C" in FIG. 1. As described above, the position and size of the triggering field, that is the zone in which the presence of a reflective object will trigger radiation sensor 174, is determined by the separation of diode 172 and the orientation of diode 172. In this respect, a more downwardly directed beam will lower the triggering field while moving the beam direction towards horizontal will raise the triggering field position.

Radiation sensor 174 detects the reflected radiation and sends a signal to the controller. The controller energizes target light 190 and indicator light 162. Target light 190 emits a visible light beam that illuminates the triggering field, as illustrated by lines "D" in FIG. 1. Target light 190 is aimed at the area in space at which an object reflects the radiation from diode 172 to radiation sensor 174. The present invention thus provides a target light 190 that illuminates the hand of a user to indicate to the user where the liquid from dispenser 10 will be dispensed. As a result, the likelihood of the user receiving a partial dose is reduced. The controller also energizes indicator light 162 to signal to the user that the dispensing cycle has started. Indicator light 162 remains energized for the duration of the dispensing cycle.

Figure 9:
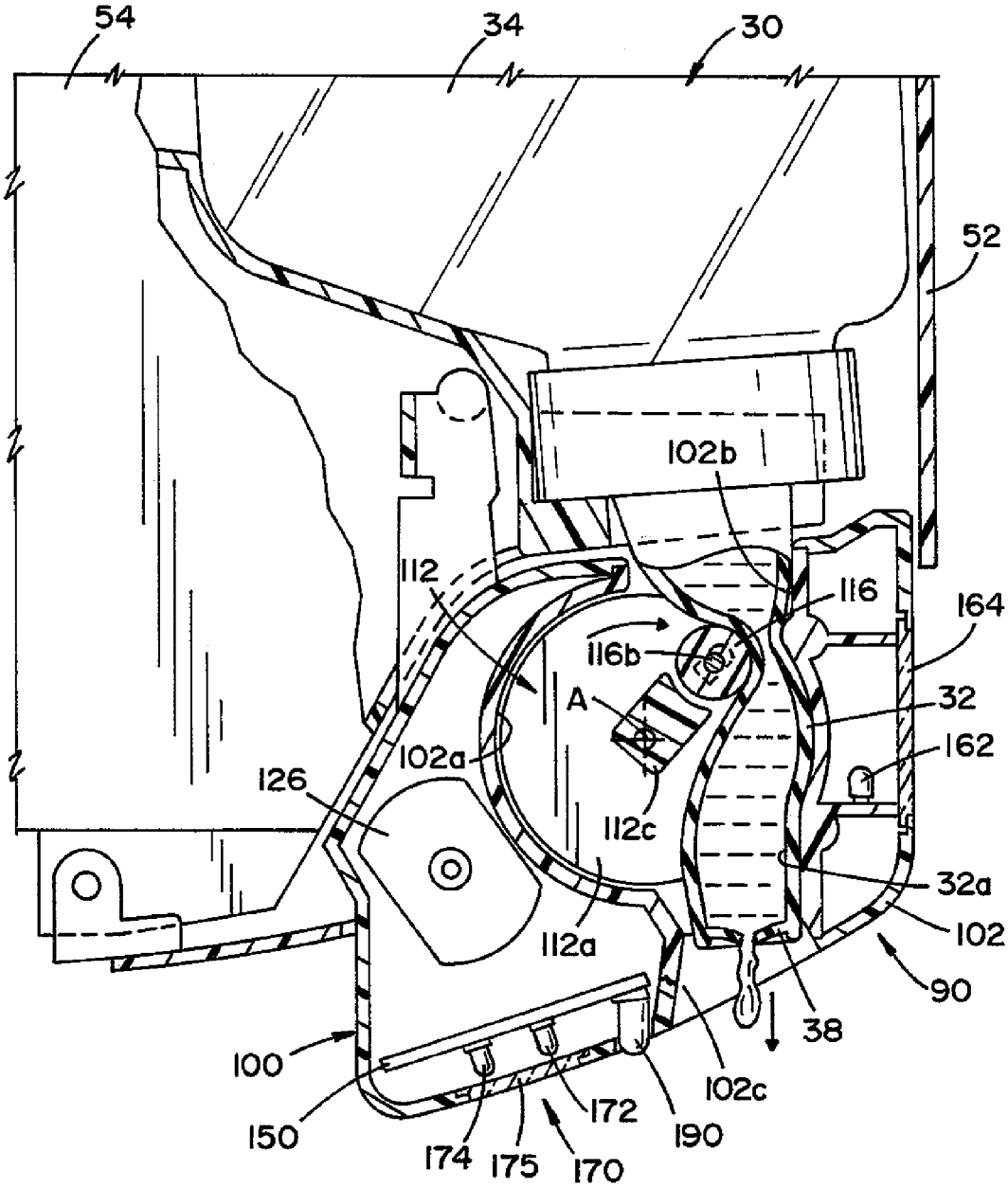
FIG. 9 is a sectional view similar to FIG. 8, illustrating a dispensing system at the initiation of a dispensing cycle.

When triggering assembly 170 detects the presence of an object in the triggering field, the controller initiates a dispensing cycle, whether the object remains in the triggering field or not. The controller energizes motor 126 such that gear assembly 114 turns in a first direction. Gear assembly 114, in turn, causes holder 112 in dispensing assembly 90 to turn in a first direction. As holder 112 turns, roller 116 rotates about axis "A" of holder 112, as shown in FIG. 9. The controller controls motor 126 to effect a predetermined amount of rotation of holder 112 of roller assembly 100 in the first direction. The lower the volume of fluid to be dispensed by dispensing system 90, the less the controller causes motor 126 to rotate holder 112 of roller assembly 100. As holder 112 rotates, tabs 115 pass through slot 158*a* in sensor 158. As stated above, sensor 158 provides a signal to the controller indicative of the presence of one of the plurality of tabs 115 in slot 158*a* of sensor 158. Based on the number of tabs 115 that pass through slot 158*a* of sensor 158, the controller determines how far holder 112 has rotated. As roller 116 rotates in the first direction, roller 116 contacts the portion of dispensing tube 32 disposed in the uppermost portion of cavity 102*a* of housing 102. As holder 112 continues to turn, roller 116 rolls downwardly along dispensing tube 32 and forces dispensing tube 32 against a portion of housing 102, as illustrated in FIG. 9. The movement of roller 116 against dispensing tube 32 squeezes pathway 32*a* of dispensing tube 32 and causes a volume of fluid to be dispensed from reservoir 30 through valve 38.

As the fluid is dispensed from reservoir 30, vent system 36 allows air to enter reservoir 30 to replace the fluid. Vent system 36 removes bioburden, such as particles of dust and microorganisms, from the air as it enters reservoir 30. Container 34 of reservoir 30 is preferably formed from a relatively rigid material, such as polyethylene or polypropylene. The filtered air entering reservoir 30 quickly returns the pressure in the region of space above the fluid within reservoir 30 to atmospheric pressure as fluid is dispensed. This reduces the suction effect that would otherwise tend to draw unfiltered air into dispensing tube 32 at the completion of the actuation stroke. Vent system 36 therefore cooperates with dispensing system 90 to reduce the possibility of unfiltered air entering pathway 32*a* of dispensing tube 32 and container 34. Vent system 36 also assists in insuring that a full dose is dispensed with each actuation by minimizing the amount of air entering dispensing tube 32.

In an alternate embodiment, container 34 of reservoir 30 is formed from a non-rigid material that collapses as fluid is dispensed. For non-rigid containers 34, vent system 36 may be eliminated, because the walls of container 34 progressively collapse as the fluid is dispensed.

Figure 10:
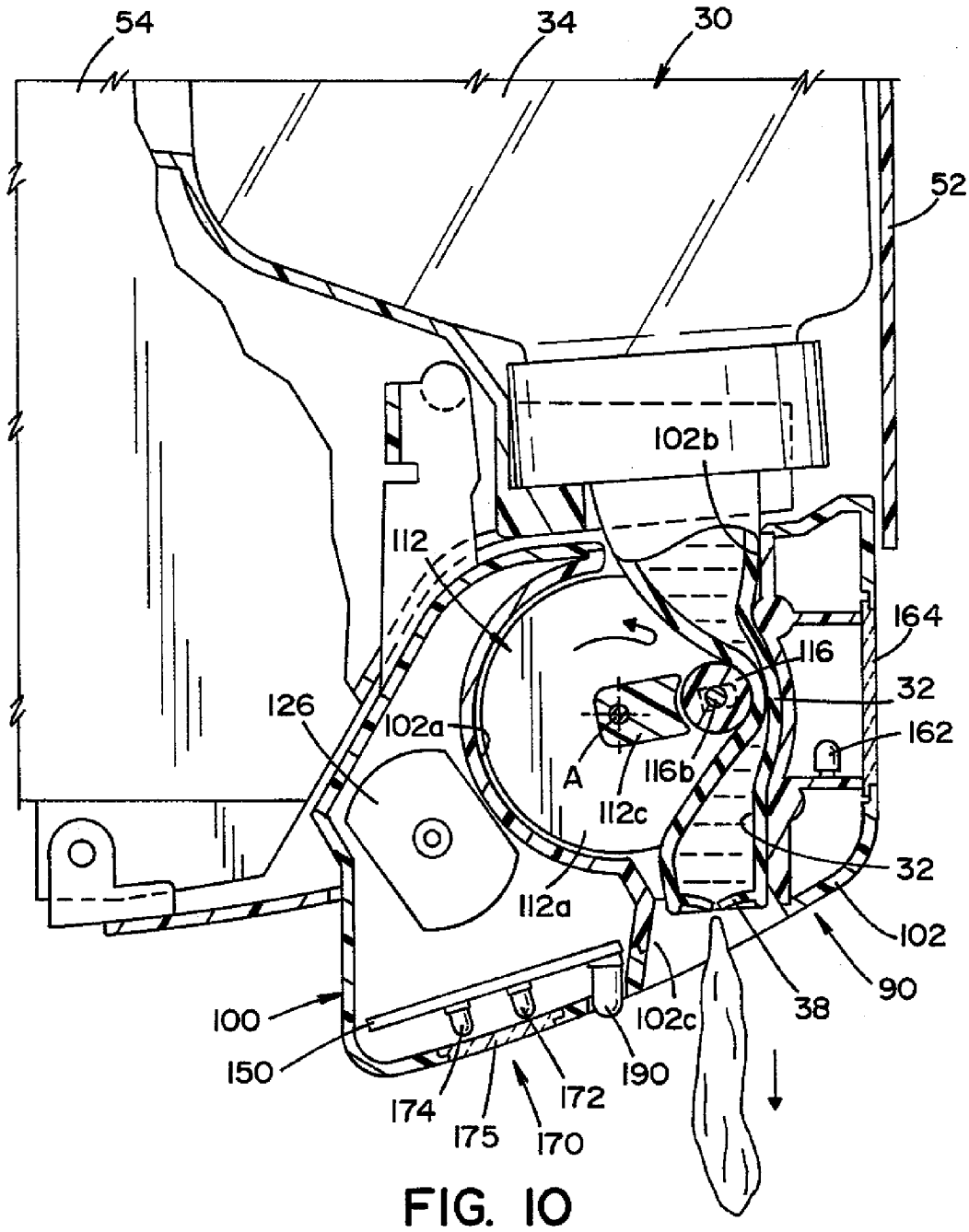
FIG. 10 is a sectional view similar to FIG. 8, illustrating a dispensing system returning to an at-rest position.

The controller continues to cause motor 126 to move in the first direction until roller 116 is disposed in a second container-engaging position, as seen in FIG. 10. Once roller 116 is in the second container-engaging position, the controller causes motor 126 to turn in a second direction, opposite the first direction. As a result, roller 116 rolls upwardly along dispensing tube 32 until roller 116 is in its uppermost, or first container-engaging position. The dispensing cycle is complete once dispensing system 90 returns to its at-rest position. At this time fluid is allowed to fill pathway 32*a* of dispensing tube 32 in preparation for a subsequent dispensing of fluid.

The controller is programmed not to allow another dispensing cycle to be initiated until a predetermined time delay has elapsed. Repeated actuations of dispenser 10, without a proper delay, may result in incomplete doses of the fluid being dispensed. The present invention thus provides a dispensing system 90 that is controlled to allow pathway 32*a* of dispensing tube 32 to completely fill with fluid prior to initiating another dispensing cycle.

When the level of fluid in reservoir 30 has reached a predetermined low level, low level indicator assembly 210 provides a signal to the controller. The controller intermittently energizes indicator light 162 to signal to a maintenance person that the level of fluid in reservoir 30 has reached a predetermined low level. The maintenance person then opens the front cover 52 to replace the fluid reservoir 30 with a full reservoir. As shown in FIG. 11, front cover 52 is pivotally mounted to back plate 54 about a lower end at laterally spaced pivot points. Front cover 52 rotates downwardly around the pivot points, providing access to container 34 and dispensing tube 32.

Figure 12:
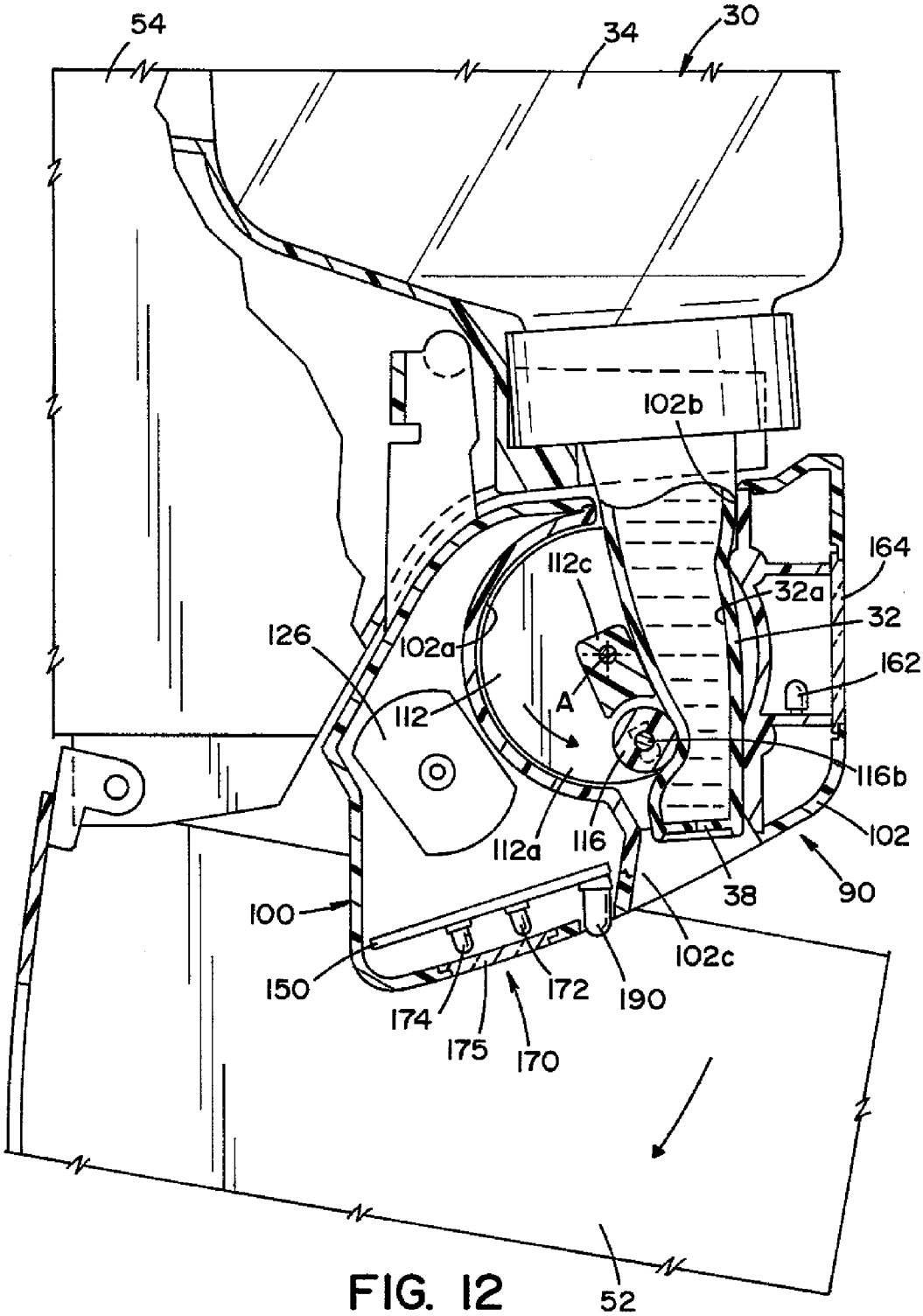
FIG. 12 is a sectional view taken along line 12-12 of FIG. 11, illustrating a roller assembly moving in a second direction during a cover open cycle of a fluid dispenser.

When front cover 52 is opened, limit switch 152 on the controller senses that front cover 52 has moved away from back plate 54. The controller then initiates a door open cycle. During the door open cycle, the controller energizes reversible motor 126 to turn holder 112 in a second direction, opposite to the first direction of rotation of holder 112 during the dispensing cycle. As motor 126 turns holder 112 in the second direction, as shown in FIG. 12, roller 116 engages dispensing tube 32 near a bottom thereof and rolls upwardly along dispensing tube 32. The movement of roller 116 forces dispensing tube 32 against a portion of housing 102, as illustrated in FIG. 12. The movement of roller 116 against dispensing tube 32 squeezes pathway 32*a* of dispensing tube 32 thereby forcing the fluid in pathway 32*a* of dispensing tube 32 into a lower portion of container 34 of reservoir 30.

As holder 112 rotates in the second direction, tabs 115 pass through slot 158*a* in sensor 158. Sensor 158 is operable to provide a signal to the controller indicative of the presence of one of the plurality of tabs 115 in slot 158*a* of sensor 158. Based on the number of tabs 115 that pass through slot 158*a* in sensor 158, the controller determines when roller 116 is in the uppermost or first container-engaging position. Once roller 116 is in the first container-engaging position, the controller causes motor 126 to stop rotating holder 112, thereby ending the door open cycle. As a result, fluid disposed above valve 38 of reservoir 30 is forced into a lower portion of container 34 of reservoir 30. The present invention thus provides a dispensing system 90 that reduces the likelihood of fluid accidentally dripping from reservoir 30 when reservoir 30 is removed from dispenser 10.

Figure 13:
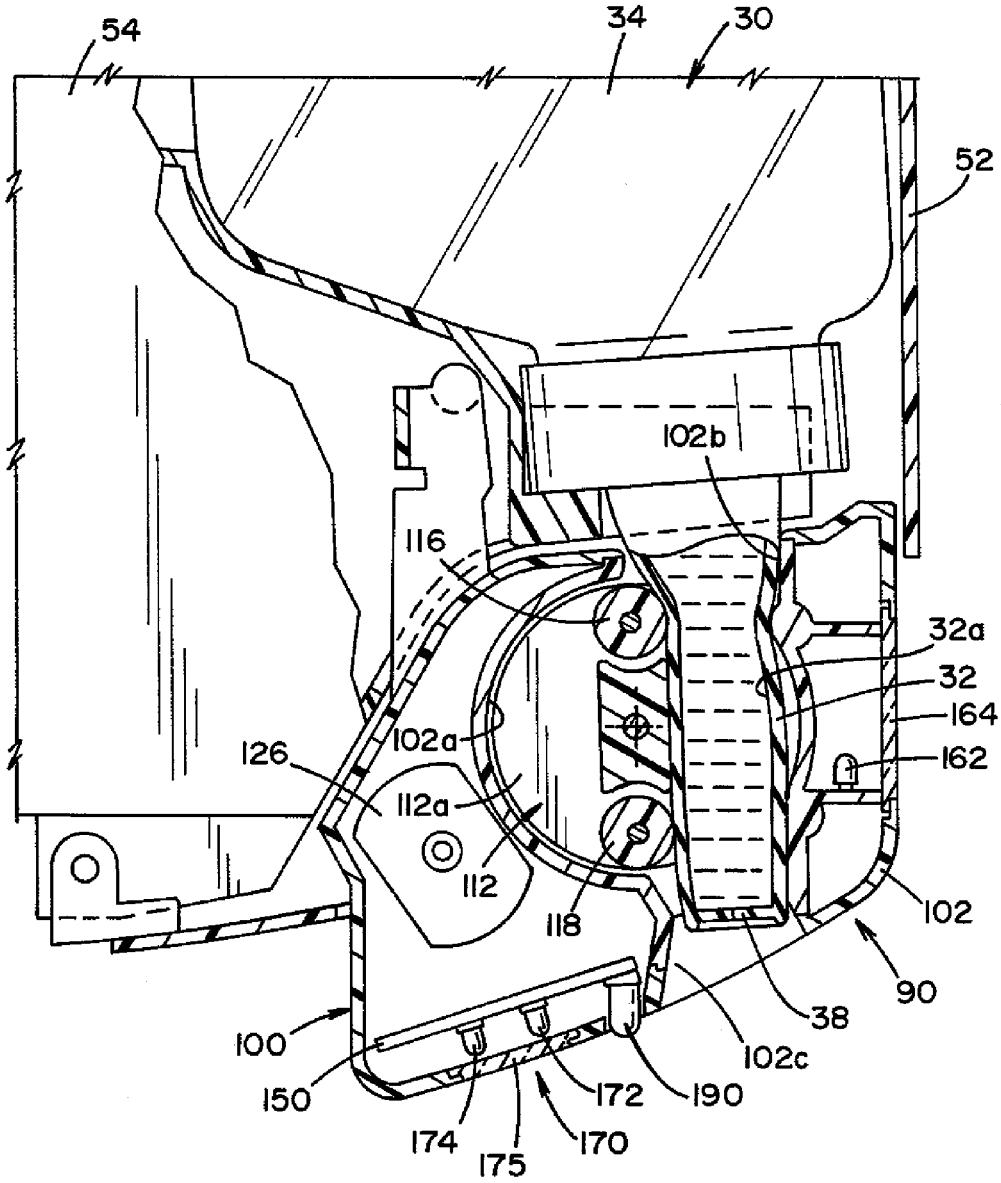
FIG. 13 is a sectional view of a dispensing system illustrating an alternate embodiment of a dispensing system at an at-rest position.
Figure 14:
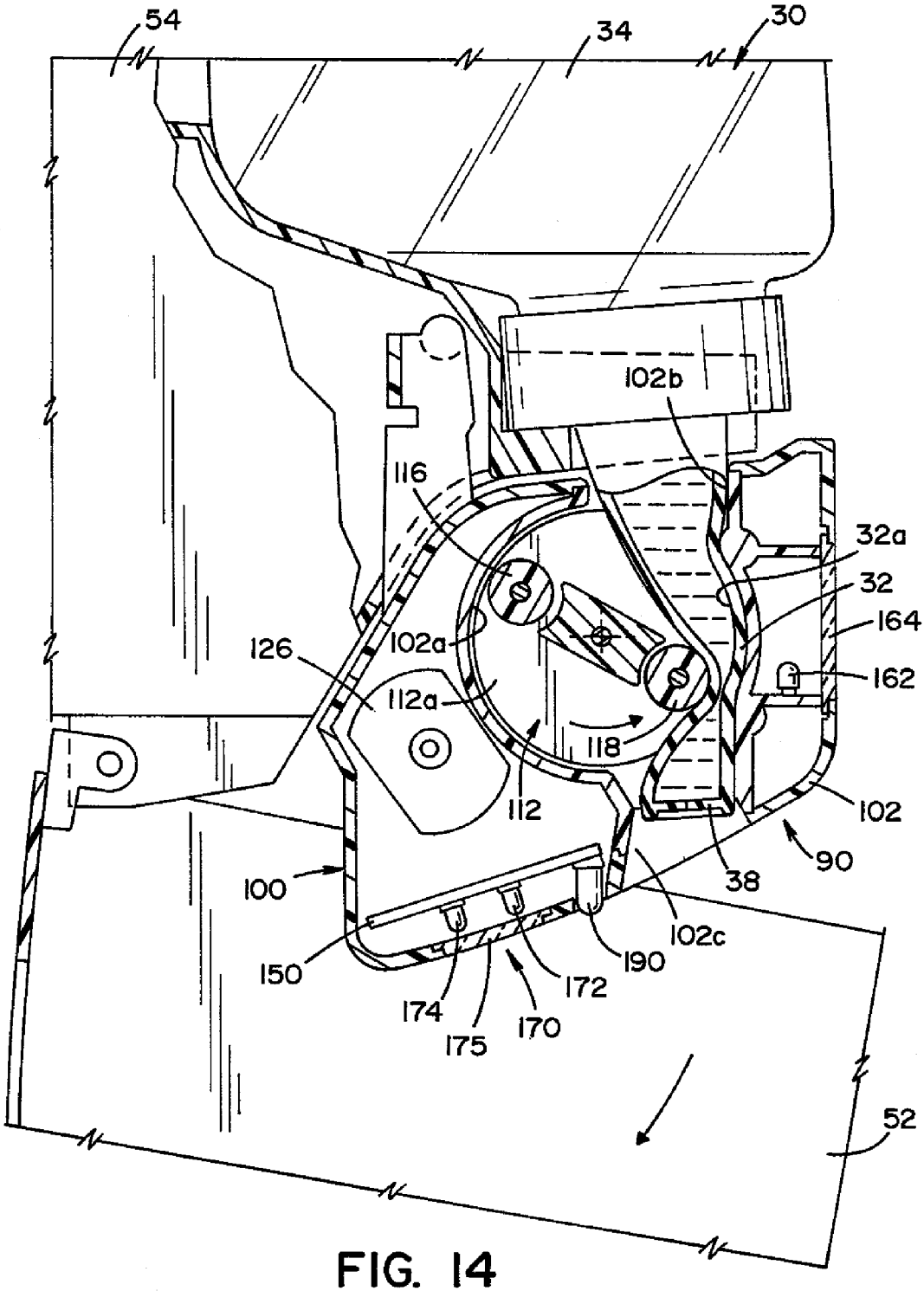
FIG. 14 is a sectional view of a dispensing system illustrating an alternate embodiment of a dispensing system moving in a second direction during a cover open cycle of a fluid dispenser.

According to another embodiment of the present invention, as best seen in FIGS. 13 and 14, holder 112 includes a second roller 118. Second roller 118 is disposed between first disk 112*a* and second disk 112*b* of holder 112, opposite roller 116. One end of second roller 118 is rotatably attached to first disk 112*a* and another end of second roller 118 is rotatably attached to second disk 112*b*. A central axis of second roller 118 is parallel to central axis "A" of holder 112.

In this embodiment, second roller 118 is disposed in a lower portion of cavity 102*a* of housing 102 and does not engage dispensing tube 32 of reservoir 30 during the dispensing cycle. However, during the door open cycle, motor 126 turns holder 112 in the second direction such that second roller 118 engages a lower portion of dispensing tube 32. As shown in FIG. 14, second roller 118 rolls upwardly along dispensing tube 32 and forces dispensing tube 32 into contact with a portion of housing 102. The movement of second roller 118 against dispensing tube 32 forces the fluid in pathway 32*a* of dispensing tube 32 into a lower portion of container 34 of reservoir 30. The controller is programmed such that motor 126 stops rotating holder 112 when second roller 118 is in the first container-engaging position. In this respect, when front cover 52 is closed, typically after a full container has been placed in dispenser 10, second roller 118 is now in the uppermost or first container-engaging position. Second roller 118 then functions to force fluid out of reservoir 30 during the dispensing cycle. The next time fluid dispenser 10 is opened, roller 116 will force the fluid in pathway 32*a* of dispensing tube 32 upwardly, in a similar manner as described above for second roller 118. Roller 116 is then in the uppermost or first container-engaging position and functions to dispense soap from reservoir 30. In this respect, this embodiment of the present invention provides a dispensing system 90 that is designed such that roller 116 and second roller 118 alternate as an uppermost roller to extend the life of each roller and maintain accurate operation of dispenser 10.

In another aspect of the present invention, the controller is programmed to maintain a count of the number of actuations of dispensing system 90 and the volume dispensed for each actuation. For a known initial volume of fluid in reservoir 30, the controller determines when the volume of the fluid in reservoir 30 is below a preset volume based on the number of actuations and the amount of fluid dispensed for each dispensing cycle. The controller then notifies the user that the volume of fluid in reservoir 30 is below a predetermined low level by intermittently energizing indicator light 162.

The present invention thus provides a dispenser that illuminates a triggering field at the initiation of a dispensing cycle. As a result, the likelihood of a user receiving an incomplete dose is reduced. Moreover, the present invention provides a dispenser wherein an indicator light notifies a user when a dispensing cycle has been initiated. The indicator light also notifies a maintenance person when the level of fluid in the dispenser is below a predetermined low level. As a result, the maintenance person is notified prior to a dispenser being empty of a fluid to be dispensed.

The foregoing description is specific embodiments of the present invention. It should be appreciated that these embodiments are described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

The invention claimed is:

1. A fluid dispenser for dispensing a fluid, said fluid dispenser comprising:

a housing dimensioned to receive a container for holding a fluid to be dispensed, said housing having a cover movable between a closed position and an open position;

a roller assembly disposed in said housing, said roller assembly being dimensioned to engage a portion of said container, said roller assembly including a holder and a roller rotatably attached to said holder, said holder being rotatable about an axis of said roller assembly such that said roller is movable along a path between a first container-engaging position and a second container-engaging position, said roller dimensioned to engage and roll along a portion of said container when said roller moves in a first direction from said first container-engaging position to said second container-engaging position, thereby dispensing said fluid from said container;

a first sensor for providing a signal indicative of the position of said roller along said path;

a volume control switch for varying a volume of fluid to be dispensed, said volume control switch having multiple fixed positions, each of said fixed positions associated with a different volume of fluid to be dispensed;

a motor operable to rotate said holder in a first direction and in a second direction, said second direction being opposite said first direction;

a second sensor for sensing an object in a predetermined area near said housing;

a light source operable to emit a beam of visible light therefrom, said beam of light intersecting said predetermined area; and a controller programmed such that when said second sensor senses an object in said predetermined area, said controller 1) energizes said light source to illuminate a target location where said fluid from said container is to be dispensed;

2) determines said second container-engaging position of said roller based on said position of said volume control switch;

3) energizes said motor to rotate said holder in said first direction such that said roller engages and moves along said path from said first container-engaging position to said second container-engaging position thereby dispensing said desired volume of fluid from said container based on said position of said volume control switch; and 4) energizes said motor to rotate said holder in said second direction, opposite said first direction, wherein said roller moves along said path from said second container-engaging position back to said first container-engaging position.

2. A fluid dispenser as defined in claim 1, further comprising:

a third sensor operable to provide a signal indicative of when said cover is in said closed position and when said cover is in said open position.

3. A fluid dispenser as defined in claim 1, wherein said second sensor is comprised of a radiation emitting diode and a radiation sensor.

4. A fluid dispenser as defined in claim 1, wherein said holder includes a pair of plates disposed on either side of a central hub.

5. A fluid dispenser as defined in claim 1, wherein said controller is programmed such that when said cover is moved to said open position said controller energizes said motor to rotate said holder in said second direction, opposite said first direction, wherein said roller engages and rolls along said portion of said container, thereby moving a fluid in said portion of said container into another portion of said container.

6. A fluid dispenser as defined in claim 1, wherein said roller assembly further comprises a second roller rotatably attached to said holder, said second roller being in a first non-engaging container position when said roller is in a first container-engaging position and said second roller being in a second non-engaging container position when said roller is in second container-engaging position.

7. A fluid dispenser as defined in claim 6, wherein said controller is programmed such that when said cover is moved to said open position said controller energizes said motor to move said holder in said second direction such that said roller moves from said first container engaging position to said first non-engaging container position and said second roller moves from said first non-engaging container position to said first, container-engaging position, wherein said second roller engages and rolls along said portion of said container and moves a fluid in said portion of said container into another portion of said container.

8. A fluid dispenser as defined in claim 1, further comprising:

a spring element for biasing said roller in an outward direction relative to said axis of said roller assembly.

9. A fluid dispenser as defined in claim 1, wherein said holder includes a plurality of indicators for determining said position of said roller along said path, said plurality of indicators dimensioned to pass through a discrete location as said holder rotates about said axis of said roller assembly.

10. A fluid dispenser as defined in claim 9, wherein said plurality of indicators is a plurality of tabs disposed on said holder.

* * * * *